United States Patent [19]

Kanto et al.

[11] Patent Number: 4,558,252

[45] Date of Patent: Dec. 10, 1985

[54] COLOR CATHODE RAY TUBE WITH FRAME, MASK OR SHIELD HAVING AN OXIDIZED LAYER

[75] Inventors: Masaharu Kanto; Hisato Kihara, both of Hyogo; Koichi Teshima, Tokyo; Michihiko Inaba, Kawasaki, all of Japan

[73] Assignee: Tokyo Shibaura Denki Kabushiki Kaisha, Kanagawa, Japan

[21] Appl. No.: 438,721

[22] Filed: Nov. 3, 1982

[30] Foreign Application Priority Data

Nov. 9, 1981 [JP] Japan ..... 56-178371

[51] Int. Cl.[4] ..... H01J 29/07; H01J 29/81

[52] U.S. Cl. ..... 313/402; 313/407

[58] Field of Search ..... 313/402, 407; 445/47

[56] References Cited

U.S. PATENT DOCUMENTS 3,647,572 3/1972 Todd et al. ..... 148/16.6
3,838,985 10/1974 Ornstein ..... 428/617
4,019,085 4/1977 Sahata ..... 313/402
4,292,565 9/1981 Kanto ..... 313/407
4,306,172 12/1981 Matsukura et al. ..... 313/402

FOREIGN PATENT DOCUMENTS 2231101 12/1974 France .

*Primary Examiner*—Palmer C. DeMeo
*Assistant Examiner*—Sandra L. O'Shea
*Attorney, Agent, or Firm*—Cushman, Darby and Cushman

[57] ABSTRACT

A color cathode ray tube having a mask frame, a shadow mask attached to the mask frame and inner shield attached to the mask frame. At least one of these parts is made substantially of iron (Fe) and has a oxidized layer on its surface. That part further includes silicon (Si), aluminum (Al) and chromium (Cr) as impurity elements in weight amounts satisfying the following relation:

$Cr \geqq \frac{1}{3}(Al+Si)$.

3 Claims, 7 Drawing Figures

COLOR CATHODE RAY TUBE WITH FRAME, MASK OR SHIELD HAVING AN OXIDIZED LAYER

BACKGROUND OF THE INVENTION

The present invention relates in general to color cathode ray tubes. More specifically, the present invention is directed to a color cathode ray tube having a mask frame, a shadow mask attached to the mask frame and an inner shield attached to the mask frame, in which at least one of these parts includes iron as its chief element and has an oxidized layer on its surface.

Generally a color cathode ray tube has a mask-frame, a shadow mask and an inner shield within an envelope. These parts include iron as a chief element. Oxidized layers are formed on their surfaces. These oxidized layers are formed so as to prevent the parts from being rusted until they are assembled in the tube, and to increase the efficiency of heat radiation and also reduce the reflection of an electron beam during the time when the cathode tube operates. The oxidized layers are formed by heat treatment in an atmosphere containing oxygen after press forming. The oxidized layer is generally a bluish black color. As a result, the oxidized layer is sometimes referred to as a blackened layer.

However, the oxidized layer causes a problem. It is weak in adhesion and it easily peels off. Peeled off oxidized particles affect the tube function seriously, such as by filling up the aperture of the shadow mask or causing a discharge to occur between tube electrodes.

Therefore, several techniques for improving adhesion of the oxidized layer have been proposed. For example, Japanese patent disclosure No. 8,963/1979 discloses reducing a silicon content of silicon added as deoxidizing agent during manufacturing of the raw steel material used to manufacture the iron parts of the tube and which remains inevitably in the steel to less than 0.03%. As another example, Japanese patent disclosure No. 90,033/1980 discloses washing the shadow mask with water containing chloric ions in an amount less than 20 ppm before oxidizing. These methods improve adhesion of the oxidized layer, however, they do not provide adequate improvement to completely overcome the problems associated with the oxidized layer.

SUMMARY OF THE INVENTION

A primary object of the present invention is to provide a color cathode ray tube, which is free from the operational difficulties caused by the filling up of the shadow mask apertures with peeled off oxidized particles and the discharges that occur between tube electrodes.

Another object of the present invention is to improve the adhesion of the oxidized layer and to prevent the oxidized layer from peeling off.

Therefore the present invention provides a color cathode ray tube having a mask frame, a shadow mask attached to the mask frame and an inner shield. At least one of these parts includes iron as its chief element and has an oxidized layer on its surface. The part further includes silicon (Si), chromium (Cr) and aluminum (Al) in amounts of weight in ppm satisfying the following relation:

$Cr \geqq \frac{1}{3}(Al+Si)$.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
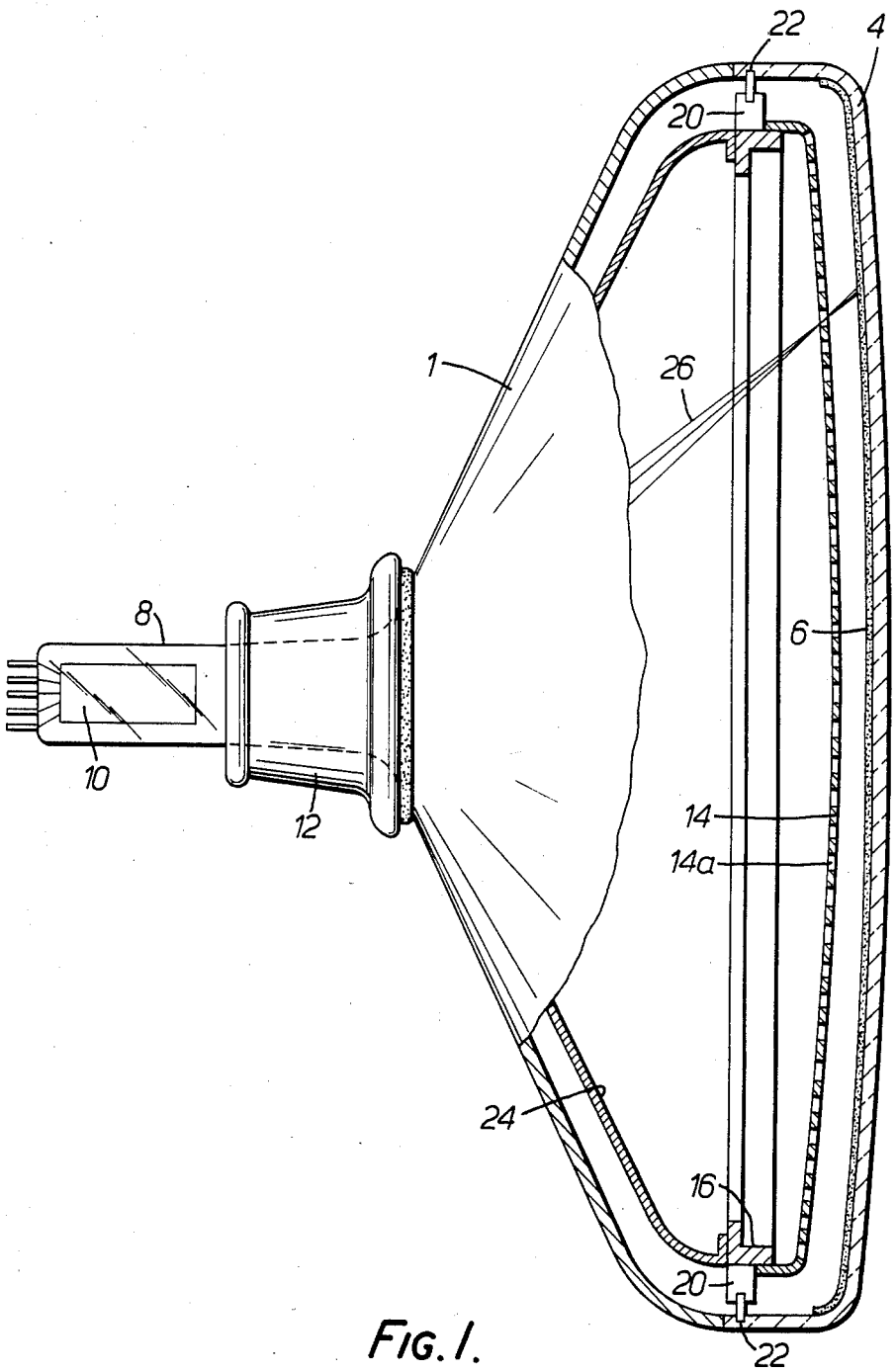
FIG. 1 is a cross-section of a color cathode ray tube according to the present invention.

Referring now to FIG. 1 there is shown a cross-section of a color cathode ray tube according to one embodiment of the present invention. A funnel 2 is joined to the outer periphery of a face plate 4, on an inner surface of which is formed a phosphor screen 6. A neck 8 is joined to an end of funnel 2. An electron gun 10 is disposed within neck 8. A deflection yoke 12 is mounted on an outer surface of funnel 2 and around neck 8. A shadow mask 14 opposes phosphor screen 6 and is mounted to face plate 4 by a mask frame 16, support members 20 and pins 22 welded in the face plate. An inner shield 24, which is provided for shielding electron beams 26 from the earth's magnetic field, is mounted to mask frame 16 along the funnel.

Electron beams 26 emitted from the electron gun are deflected by deflection yoke 12, pass through an aperture of shadow mask 14 and impinge upon phosphor screen 6 to cause a color image to appear on the face of the tube.

In the above described structure, shadow mask 14, mask frame 16 and inner shield 24 are made of steel containing iron as its chief element and their respective surface layers are oxidized. Further all of these iron parts include silicon (Si), aluminum (Al) and chromium (Cr) in weight ppm amounts satisfying the following relation:

$Cr \geqq \frac{1}{3}(Al+Si)$.

Experiments conducted by the inventors in connection with the development of the present invention, will be described below.

The inventors made a shadow mask from a raw steel material that is easily precisely etched and is not very susceptible to stretcher strain during press forming. The raw steel material was prepared by a continuous cast method including the addition of aluminum and decarbonizing anneal. The use of a continuous cast method of manufacture decreases impurities and non-metal mixtures in the raw steel material to a high degree and the uniformity of the raw steel material is improved. The preciseness of etching is thereby improved. Carbon and nitrogen increase the yield point and stretcher with yield point, and they degrade press forming performance. Therefore aluminum is added into the raw steel material for fixing nitrogen as aluminum nitride and decarbonizing anneal is performed for reducing carbon, and thereby stretcher with yield point is suppressed and an occurrence of stretcher strain is prevented.

Figure 2:
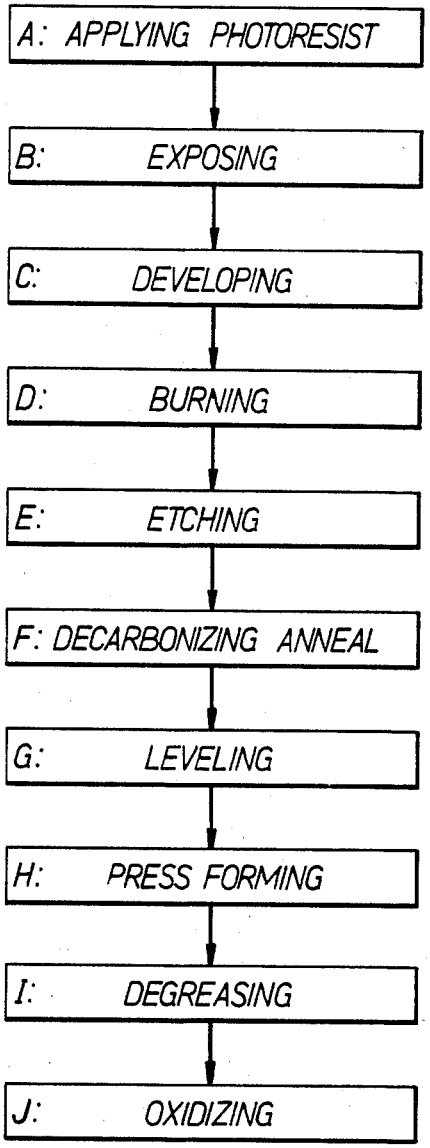
FIG. 2 is a flow chart of manufacturing steps for the tube's shadow mask.

Referring now to FIG. 2, the steps of manufacture of the shadow mask from raw steel material are set forth. Step A represents the coating of a photoresist material on a steel strip. Step B represents exposing the photoresist material with a dots or slits pattern of light. In step C the exposed photoresist material is developed. In step D the developed photoresist material is heated for hardening. This step is sometimes referred to as a burning step. Step E represents etching of the steel strip with the developed photoresist material thereon. The etching of the steel strip, creates apertures in it to form an apertured steel strip. After etching in step E, washing, drying and cutting steps are performed (not represented in the block diagram). The cutting, provides a plurality of flat masks for color cathode ray tubes. After cutting, and in step F, a flat mask is annealed at a temperature of about 700° C. for decarbonizing it. After decarbonizing a leveling operation is carried out at step G, in which step the flat mask is rolled for flatness adjustment. At step H, press forming is carried out for forming the apertured flat mask to have a curvature shape. Step I represents a degreasing of the curved mask. In oxidizing step J, the shadow mask is oxidized by heat treatment at a temperature of about 600° C. in an atmosphere of $CO_2$-$N_2$ including a very small amount of $H_2O$ or $O_2$.

The used raw steel material contains so much aluminum, which is added for fixing nitrogen, that the oxidized layer formed on the surface of the shadow mask tends to be easily peeled off. The inventors conducted several experiments and they found that the adhesion of the oxidized layer depends on not only the amount of aluminum in the shadow mask but also the amount of chromium. The experimental data is shown in Table 1.

TABLE 1

| Sample | Composition (ppm) | | | | | | | Adhesion |
|---|---|---|---|---|---|---|---|---|
| | C | Mn | S | P | Si | Al | Cr | |
| (a) | 55 | 2350 | 130 | 161 | 10 | 1 | 489 | O |
| (b) | 36 | 2870 | 228 | 157 | 40 | 479 | 182 | Δ |
| (c) | 39 | 2660 | 191 | 153 | 130 | 397 | 74 | X |

O: good,
Δ: good, however partially peeled off,
X: bad

Figure 3:
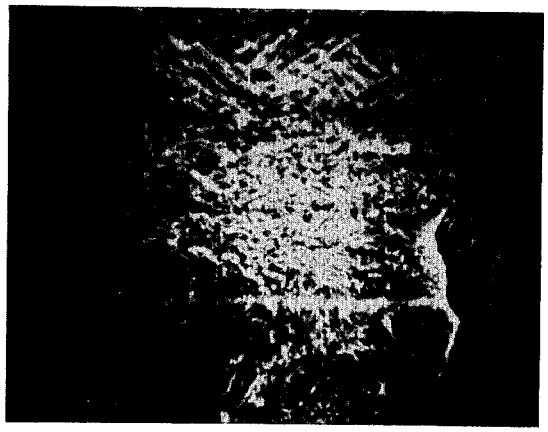
FIG. 3 is a microscopic photograph showing the oxidized layer after an adhesion test.
Figure 4:
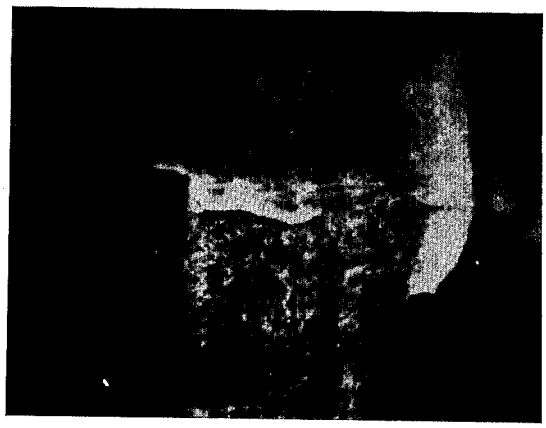
FIG. 4 is a microscopic photograph showing another oxidized layer after the adhesion test.

The test was conducted as follows. The oxidized shadow mask was bent at an angle of 90° and an adhesive cellophane tape was applied to the bent portion and then removed. The result of the test showed that sample (a) demonstrated good adhesion without any peeling as shown in FIG. 3. On the other hand, sample (c) demonstrated an adhesion as shown in FIG. 4 which indicates cracks of the oxidized layer.

Figure 5:
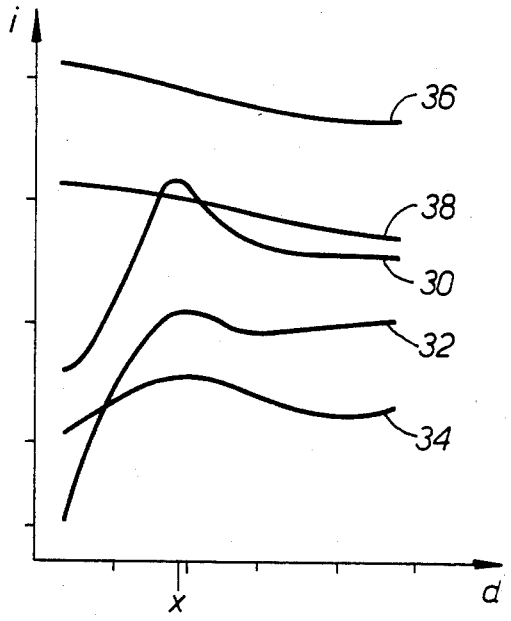
FIG. 5 is a chart showing the contained amounts of the elements along the depth direction of the shadow mask.
Figure 6:
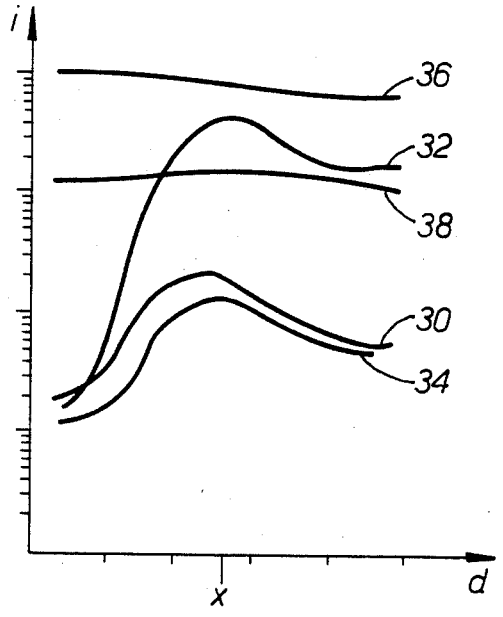
FIG. 6 is a chart showing the contained amounts of the elements along the depth direction of another shadow mask.

Further, the inventors conducted analysis of the composition along the depth direction from the surface of the shadow mask by an ion micro analyzer. FIGS. 5 and 6 show the test results. The horizontal axes indicate depth (d) from the surface of the shadow mask and the vertical axes indicate the detection intensity on a logrithmic scale. An x-mark on each horizontal axis denotes the border between the oxidized layer and the shadow mask. FIG. 5 shows the test results for sample (a) and FIG. 6 shows the test results for sample (c). Curves for chromium, aluminum and silicon 30,32 and 34, respectively, gradually increase from the surface of oxidized layer to the border, and have maximum values near border X. Behind the border, that is in the shadow mask, they are relatively constant with changing depth. On the contrary, the curves for iron and manganese 36 and 38, respectively, show relatively constant values through their entire cross of both the oxidized layer and the shadow mask. A typical difference between FIGS. 5 and 6 is found in a relation between curves of chromium and aluminum 30 and 32, respectively. Silicon is already known to affect adhesion of the oxidized layer as shown by Japanese Patent Disclosure No. 8,963/1979 described above. Curves of chromium, aluminum and silicon 30, 32 and 34, respectively, are extremely different from curves of iron and manganese 36 and 38. This demonstrates that chromium, aluminum and silicon affect adhesion of the oxidized layer. Therefore the inventors conducted a further test wherein the amounts of chromium, aluminum and silicon were changed. This further test is reported in Table 2 and was carried out in a similar fashion to the test reported in Table 1.

TABLE 2

| Sample | unit (ppm) | | | | Adhesion |
|---|---|---|---|---|---|
| | Cr | Al | Si | Al + Si | |
| a | 489 | 1 | 10 | 11 | O |
| d | 980 | 364 | 231 | 595 | O |
| e | 2014 | 895 | 207 | 1192 | O |
| f | 2390 | 1932 | 78 | 2010 | O |
| g | 2005 | 350 | 1200 | 1550 | O |
| b | 182 | 479 | 40 | 539 | Δ |
| h | 780 | 1323 | 157 | 1480 | Δ |
| i | 1620 | 1895 | 275 | 2170 | Δ |
| j | 993 | 1233 | 1340 | 2573 | Δ |
| c | 74 | 397 | 130 | 527 | X |
| k | 195 | 562 | 748 | 1310 | X |
| l | 410 | 1237 | 778 | 2015 | X |
| m | 576 | 1250 | 1330 | 2580 | X |

O: good,
Δ: good, however partially peeled off,
X: bad

Figure 7:
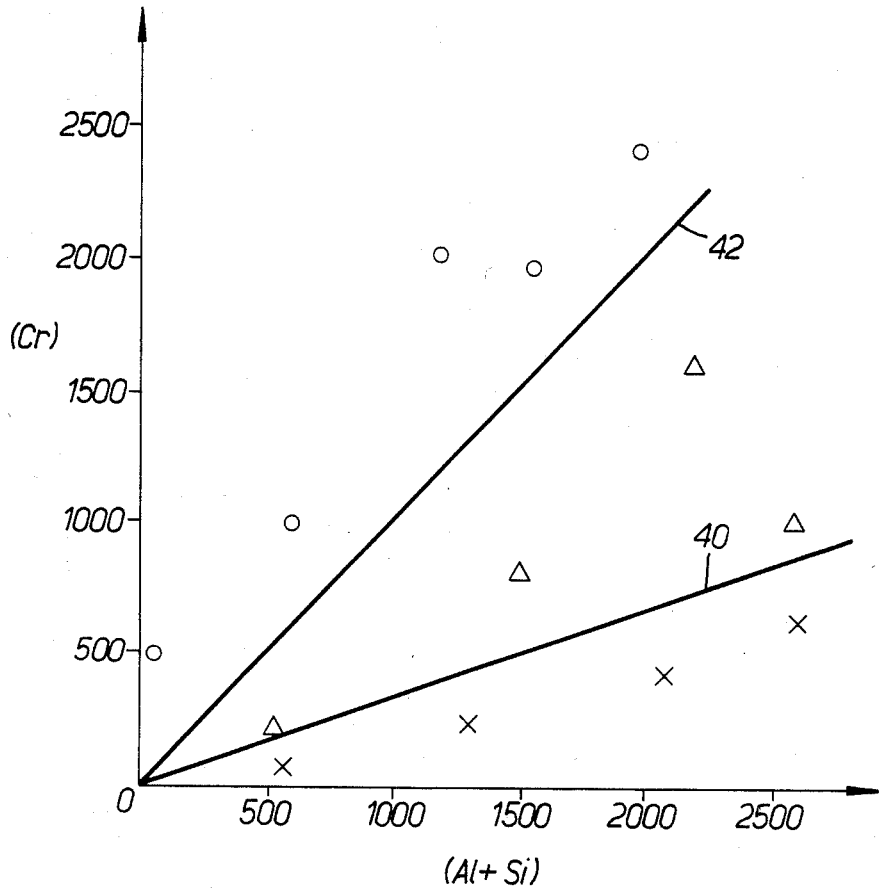
FIG. 7 is a chart showing a relationship between the contained amounts of chromium and (aluminum & silicon).

It is difficult to find a mutual relation between individual chromium, aluminum and silicon with respect to the adhesion of the oxidized layer. However, it can be found that a mutual relation exists between chromium and (aluminum+silicon). FIG. 7 shows this mutual relation. The horizontal axis indicates an amount of (aluminum+silicon) and the vertical axis indicates an amount of chromium. The o-marks denote the good and the x-marks denote the bad. The Δ-marks denote the good, however partially peeling off are recognized. Improvement of adhesion is found in the region above a straight line 40, representing $Cr=\frac{1}{3}(Al+Si)$ as shown in FIG. 7. The region above a straight line 42, which is indicated by $Cr=(Al+Si)$, is particularly preferable. The shadow masks included in this region have oxidized layers demonstrating good adhesion with no problem of peeling off of the oxidized layer if the shadow mask is handled in the ordinary manner.

With respect to the amount of silicon, which is added as a deoxidizing agent during manufacturing the raw steel material and inevitably remains therein, it is found that an increase in amount of silicon does not harden the raw steel material more than necessary under the above mentioned condition, even though conventionally it causes a phenomenon of hardening the raw steel material. This is confirmed by example (g) shown in Table 2. It can be considered that chromium fixes carbon as chromium carbide and easiness in forming the shadow mask is thereby improved.

The present invention is accomplished from the above described experiments and the discussions.

Therefore according to the present invention, the shadow mask having a oxidized layer on its surface include iron as a chief element, chromium, aluminum and silicon. The weight ppm amounts of chromium, aluminum and silicon meet the following relation.

$$Cr \geqq \frac{1}{3}(Al+Si)$$

To this end, adhesion of the oxidized layer can be remarkably improved and peeling of the oxidized layer is prevented. Therefore a strict control for forming the oxidized layer is unnecessary.

According to the present invention, an amount of aluminum can be increased within the region of $Cr \frac{1}{3}(Al+Si)$. This means that the raw materials are less susceptible to stretcher strain and are easily precisely etched. The raw steel material can be made by continuous cast method to reduce impurities and non-metal impurities for improving the precision of etching. Further, nitrogen contained in the raw steel material can be fixed by aluminum added and carbon and be reduced by decarbonizing aneal for suppressing stretcher with yield point and for preventing the occurrence of stretcher strain.

Further, an increase in amount of silicon within the region of $Cr \geqq \frac{1}{3}(Al+Si)$ does not affect performance of the raw steel material. This means that a troublesome strict control for reducing the amount of silicon can be eliminated.

In the exemplary embodiment described, a discussion is made with respect to only a shadow mask. However, above described discussion is also applicable to a mask frame and an inner shield.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A color cathode ray tube comprising:

an envelope having a face plate, a funnel portion joined to said face plate and a neck portion joined to said funnel portion;

an electron gun disposed within said neck portion;

a phosphor screen formed on said inner surface of said face plate;

a mask frame mounted to said face plate;

a shadow mask attached to said mask frame, said shadow mask having a plurality of apertures therein and which faces said phosphor screen; and an inner shield attached to said mask frame;

wherein at least one part of said mask frame, said shadow mask and said inner shield is made substantially of iron and has an oxidized layer on a surface thereof, said iron part further including silicon, aluminum and chromium as impurity elements in weight amounts satisfying the following relation:

$$Cr \geqq \frac{1}{3}(Al+Si)$$

wherein $Cr+Al+Si \leqq 0.44$ percent by weight, to enhance the adhesion of the oxidized layer.

2. A color cathode ray tube according to claim 1, wherein the weight amounts of silicon, aluminum and chromium satisfy the following relation:

$$Cr \geqq (Al+Si).$$

3. A color cathode ray tube according to claim 1, wherein said iron part is said shadow mask.

* * * * *